United States Patent [19]

Kretchman et al.

[11] 4,432,528

[45] Feb. 21, 1984

[54] EASY SERVICE MOTOR MOUNT FOR AN AUTOMATIC WASHER

[75] Inventors: Gerald L. Kretchman, St. Joseph; Anthony Mason, Lincoln Township, Berrien County, both of Mich.

[73] Assignee: Whirlpool Corporation, Benton Harbor, Mich.

[21] Appl. No.: 179,897

[22] Filed: Aug. 20, 1980

[51] Int. Cl.[3] ..... F16M 13/00

[52] U.S. Cl. ..... 248/603; 248/500; 248/507; 248/635; 248/680

[58] Field of Search ..... 248/27.1, 500, 507, 248/603, 604, 605, 620, 621, 638, 680, 681; 74/421 A

[56] References Cited

U.S. PATENT DOCUMENTS

| | | | |
|---|---|---|---|
| 1,935,211 | 11/1933 | Krohn | 74/421 A X |
| 1,959,251 | 5/1934 | Titterington . | |
| 1,971,968 | 8/1934 | Schmitter | 74/421 A |
| 1,988,338 | 1/1935 | Schmitter et al. | 74/421 A |
| 2,089,066 | 8/1937 | Morill . | |
| 2,096,621 | 10/1937 | Skolfield | 248/604 |
| 2,716,350 | 8/1955 | Phares | 74/421 A X |
| 2,757,889 | 8/1956 | Cady | 248/27.1 |
| 2,994,395 | 8/1961 | Hall | 248/507 X |
| 3,203,353 | 8/1965 | Ruby . | |
| 3,508,729 | 4/1970 | Wilson . | |
| 3,604,820 | 9/1971 | Scheller et al. . | |
| 3,941,339 | 3/1976 | McCarty | 248/603 |
| 4,043,708 | 8/1977 | Greenfield . | |

FOREIGN PATENT DOCUMENTS

| | | | |
|---|---|---|---|
| 729567 | 5/1955 | United Kingdom | 248/500 |

*Primary Examiner*—William H. Schultz

*Attorney, Agent, or Firm*—Hill, Van Santen, Steadman & Simpson

[57] ABSTRACT

A means for mounting a motor to a transmission is provided by forming a plurality of pilot studs on the motor housing to engage in resilient bushings in a mounting plate connected to the transmission, and providing tension arms to removably secure the motor to the transmission.

11 Claims, 6 Drawing Figures

FIG. 3
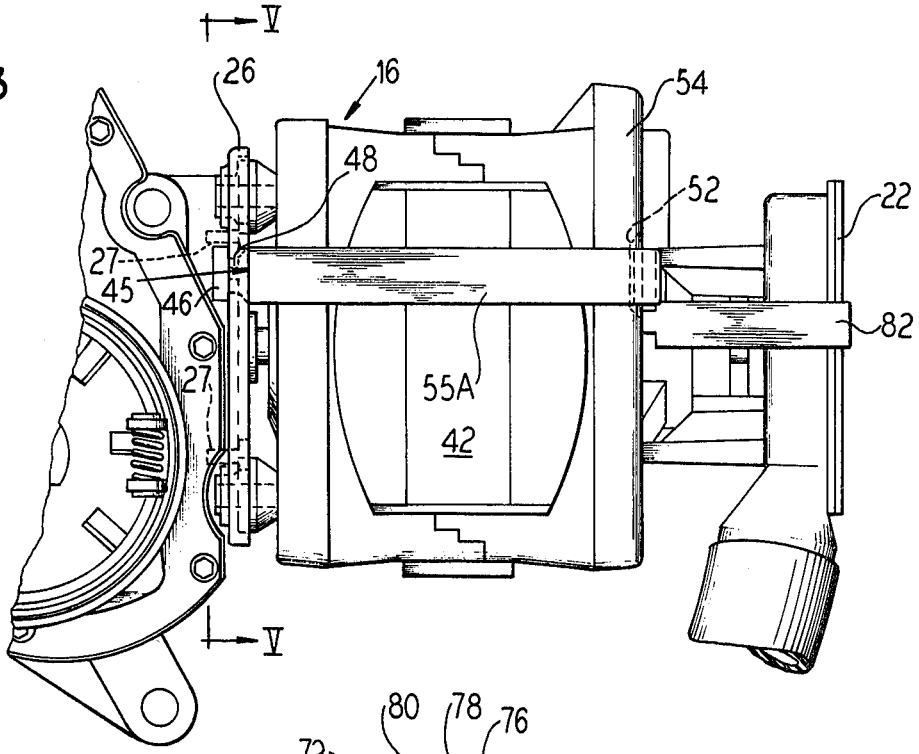
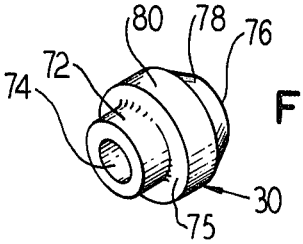
FIG. 4
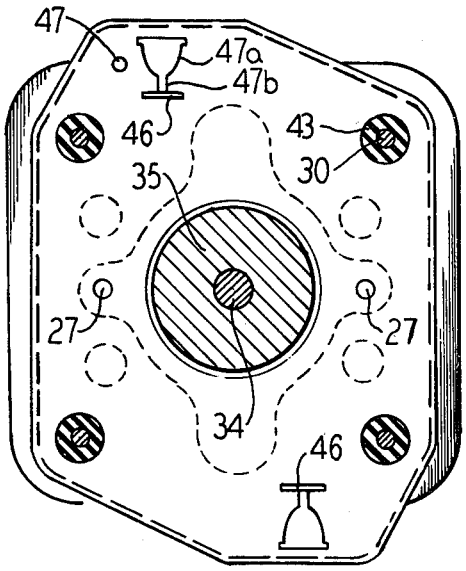
FIG. 5
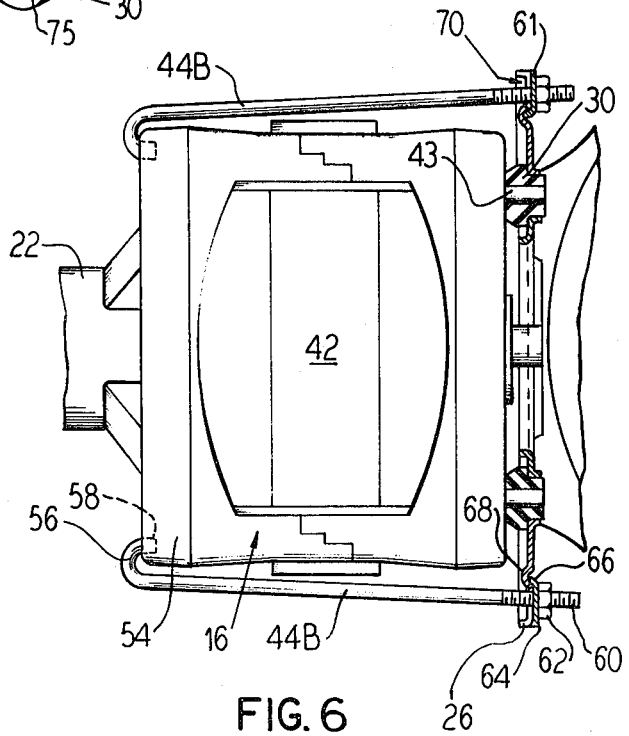
FIG. 6

EASY SERVICE MOTOR MOUNT FOR AN AUTOMATIC WASHER

BACKGROUND OF THE INVENTION

1. Field of the Invention

This invention relates to a means for mounting a motor to a gear case and more particularly to a means for mounting an electric motor to a gear case in an automatic washing machine.

2. Description of the Prior Art

Servicing an automatic washer may be a somewhat difficult job if the machine is located in a cramped environment which interferes with the manipulation of the weight and bulk of the machine. Access to various components such as the motor is often limited. Hence, a real need exists for providing a mounting means for the motor which requires very little effort to disengage or reassemble and which also securely retains the motor in operable position with the transmission in a vibration absorbing manner.

U.S. Pat. No. 3,203,353 discloses a vibration dampening motor to pump housing mounting wherein a resilient annular seal 5 is provided between the pump housing and the motor. Rods 8 tension the motor and pump housing against the seal. The rods bear against the end of the motor and opposite the seal 5 and pass through oversized openings 9 in the motor casing to prevent rod contact with the casing at the seal end. This coupling is provided to suppress the transmission of vibrations from the motor to the pump.

U.S. Pat. No. 2,089,066 discloses a motor vibration mounting having through bolts 26 in the motor housing.

U.S. Pat. No. 1,959,251 discloses tension springs 20 utilized to hold a motor cover in position.

U.S. Pat No. 4,043,708 discloses, in FIG. 7, a fan motor mounting having a resilient material to dampen sound vibrations and flexible steel cable to retain the motor against the resilient material.

U.S. Pat. No. 3,941,339 discloses resilient grommets 26 receiving studs 32 on a motor.

U.S. Pat. No. 3,604,820 discloses a noise dampening seal 7 mounted on a cover plate 15 and secured under tension by cover 8.

U.S. Pat. No. 3,508,729 discloses the use of resilient legs 36 to attach a fan motor.

SUMMARY OF THE INVENTION

The present invention provides for an easy service motor mount for an automatic washer. An electric motor used in an automatic washing machine is operably connected on one end to a water pump and on an opposite end it is operably connected to the gear casing of the transmission which in turn drives the agitator.

A mounting plate is provided on the gear casing and has a plurality of holes therethrough for receiving resilient bushings tending to absorb motor vibration transmitted by the drive shaft of the motor. The resilient bushings are connected to the motor housing by means of pilot studs which are formed in an end of the motor housing. Four pilot studs are provided to permit positive location of the motor with respect to the mounting plate during the reassembly procedure.

Two or more tension arms external of the motor housing are connected at one end to the mounting plate and at an opposite end of the motor housing end bell, adjacent the pump. The long length of the tension arms tends to dampen the motor vibration. The tension arms may be comprised of spring clips which are received in the mounting plate and which snap into a recess formed in the end bell to secure the motor against the bushings.

In an alternative embodiment of the invention, the tension arms may be comprised of draw bolts which are secured at a hooked end to the end bell of the motor housing and which are retained in a slot in the mounting plate at the threaded end. Loosening a nut on the threaded end permits easy and quick removal of the motor from the gear case just as flexing the spring clips also permits easy and quick removal.

Thus, the invention provides for a motor to gear case mounting wherein a plate member is secured to the gear case, the plate having a plurality of openings for receiving resilient bushings connected to the motor housing and having at least two tension arms external of the motor housing. The tension arms are connected to the plate and to the opposite end of the motor from the plate for securing the motor against the resilient bushings and are also easily and quickly removable. Pilot studs are provided to simplify the reassembly procedure. The entire assembly acts to substantially reduce the transmission of vibrations from the motor to the gear case.

DESCRIPTION OF THE DRAWINGS

FIG. 3 is a plan view of the motor and pump.

FIG. 4 is a perspective view of the resilient bushing seen in FIG. 3.

FIG. 5 is a view of the mounting plate taken along lines V—V of FIG. 3.

FIG. 6 is a side view similar to the motor and pump assembly shown in FIG. 2 with an alternative embodiment of the tension arms.

DESCRIPTION OF THE PREFERRED EMBODIMENTS

Figure 1:
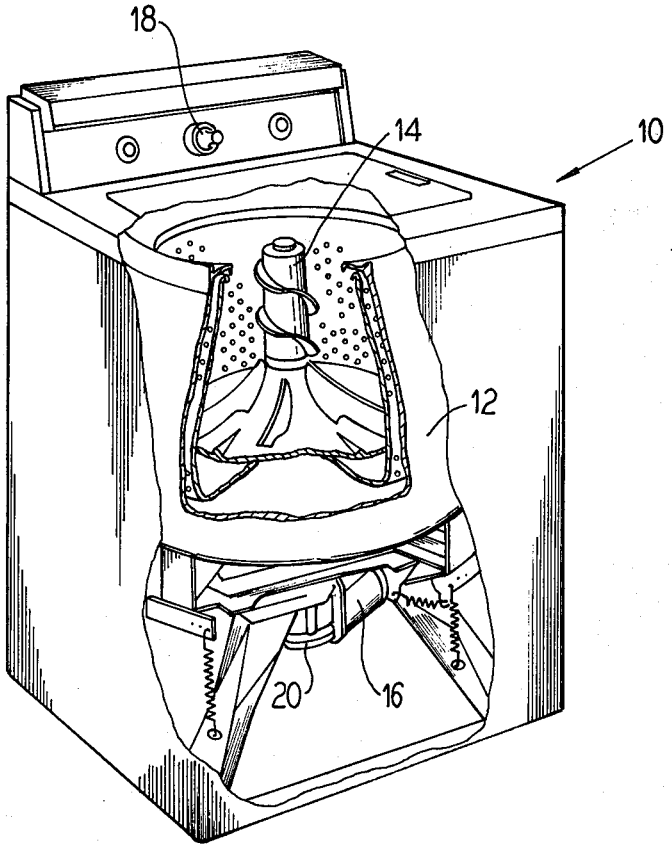
FIG. 1 is a perspective view of a washing machine with a partial cut-away to show the mechanical means within the washing machine including a tub with a vertical agitator driven by a motor and transmission.

In FIG. 1 a washing machine is generally shown at 10 as having a tub 12 with a vertical agitator 14 therein, a water supply (not shown), an electrically driven motor 16 operably connected via a transmission 20 to the agitator 14, and controls 18 including a pre-settable sequential control means for use in selectively operating the washing machine 10 through a programmed sequence of washing, rinsing and drying steps.

Figure 2:
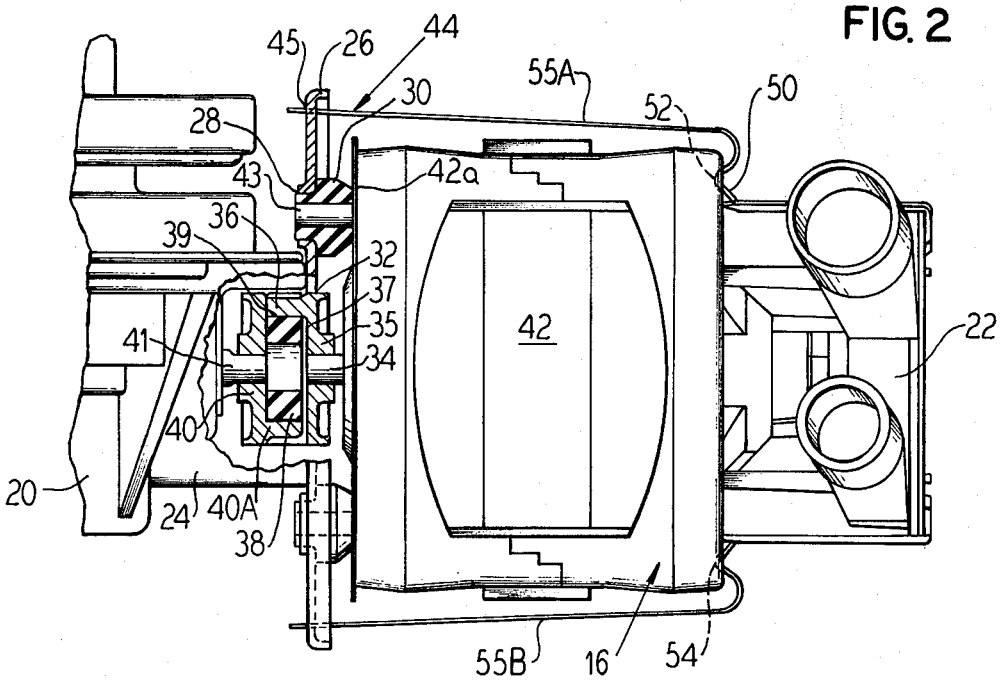
FIG. 2 is a side view of a motor and pump assembly of FIG. 1 with a partial section showing the motor connection with the transmission and the mounting plate.

Referring to FIG. 2, the motor 16 is shown in assembly with the transmission 20 and a pump 22. Transmission or gear casing 24 is provided with a mounting plate 26 secured thereto by two bolts 27 (FIGS. 3 and 5). The plate 26 has a plurality of openings 28 therethrough to receive a like number of resilient bushings 30. Additionally, a central opening 32 is provided to receive a drive shaft 34 and a first drive disc 35 of the motor 16.

The drive shaft 34 of the motor 16 is keyed to the first drive disc 35 having fingers 36 projecting in an axial direction away from a surface 37 of the first driving disc 35. The fingers 36 of the first driving disc 35 are received in a second driving disc 38 having apertures 39 for receiving the fingers 36. The second driving disc 38 is made of rubber or other resilient material. A third driving disc 40 having fingers 40*a* is provided on the opposite side of the second driving disc 38 in a manner similar to the mating of the first driving disc 35 and second driving disc 38. The third driving disc 40 is keyed to a transmission input shaft 41 which operably connects with the transmission 20.

The motor 16 is encased in a housing 42 which has thereon a plurality of pilot studs 43, each of which is received in one of the bushings 30. The pilot studs 43 are generally parallel to the drive shaft 34 of the motor 16 and project out of an end 42*a* of the motor 16 which is adjacent the mounting plate 26.

Tension arms 44 are provided to secure the motor 16 to the mounting plate 26. In the embodiment shown in FIGS. 2 and 3, the tension arms 44 are comprised of spring clips 55A and 55B which are secured at one end to the mounting plate 26 by way of a T-bar means 45 between the spring clip and the mounting plate 26.

An example of such a T-bar means 45 is shown in FIGS. 3 and 5 and comprises a female portion such as a slot 47 formed in the mounting plate 26 having a large opening portion 47*a* to receive a male portion which conveniently comprises an end of the spring clip 55A having a slender section 48 so that an end 46 of the spring clip 55A is captured against plate 26 after the spring clip 55A has been inserted into the large opening portion 47*a* and moved toward a narrow opening portion 47*b*. In this position slender section 48 is fitted within opening 47*b* and end 46 of the spring clip 55A is retained against the plate 26.

The opposite end of the spring clip 55A is curved to form a protrusion 50 mating with a recess 52 formed in an end bell 54 of the motor housing 42 at the end of the motor 16 opposite the transmission case 24.

The two spring clips 55A and 55B are used to retain the motor 16 against the mounting plate 26. Clip 55A is disposed on the top of the assembly and clip 55B is disposed diametrically oppositely at the bottom of the assembly.

To remove the motor 16 from the mounting plate 26, a serviceman need only spring the protrusions 50 out of the recesses 52 formed in the end bell 54. This allows for easy removal of the motor 16 since the two spring clips 55A and 55B comprise the sole retaining means for retaining the motor 16 against the bushings 30 and the mounting plate 26.

To reassemble the motor 16 to the mounting plate 26, the serviceman need only line the pilot studs 43 up with the bushings 30 to achieve positive location of the motor with respect to the mounting plate 26 and then push the curved end of the spring clips 55A and 55B towards the motor casing 42 so that the protrusions 50 are received in the recesses 52.

The long length of the spring clips 55A and 55B tends to dampen vibration caused by the motor 16. The resiliency of the spring clips and the resiliency of the bushings 30 further dampens the vibration between the motor 16 and the transmission 20.

An alternative tension arm means is shown in FIG. 6 comprising a pair of draw bolts 44B, each having a curved end 56 to be received in an aperture 58 in the end bell 54 of the motor 16. An opposite end of the draw bolt 44B is comprised of a threaded portion 60 which receives a nut 62 and a clip 64. The clip 64 is generally flat with a lip 66 at an end thereof which is to be received in an indentation 68 in the mounting plate 26. A slot 70 is provided in the mounting plate 26 for receiving the draw bolt 44B. With the draw bolt 44B positioned within the slot 70 of mounting plate 26 and the lip 66 of the clip 64 received in the indentation 68 of the mounting plate 26, the nut 62 is threaded onto the draw bolt 44B thereby retaining the motor 16 against the bushings 30 and the mounting plate 26.

To remove the motor 16 from the mounting plate 26 with this embodiment, a serviceman need only loosen the nuts 62 sufficiently to permit the lip 66 of the clip 64 to disengage from the indentation 68 of the mounting plate 26 thereby permitting the draw bolt 44B to disengage from the slot 70 of the mounting plate 26. This also allows for easy removal of the motor 16 since the two draw bolts 44B comprise the sole retaining means for retaining the motor 16 on the mounting plate 26 of the transmission casing 24.

To reassemble the motor 16 to the mounting plate in this embodiment of the invention, the serviceman need only line the pilot studs 43 up with the bushings 30 to achieve positive location of the motor with respect to the mounting plate 26, slide the draw bolt into the slot 70 of the mounting plate 26 and then tighten the nuts 62 so that the lip 66 of the clip 64 engages with the indentation 68 of the mounting plate 26.

The resilient bushing 30 is shown in FIG. 4 and is comprised of a cylindrical body 72 having a cylindrical opening 74 therethrough for receiving the pilot studs 43. A shoulder 75 is provided to abut against the mounting plate 26. The cylindrical portion 72 is received in the openings 28 of the mounting plate 26. A conical section 78 and cylindrical section 80 are joined to portion 72 to provide a flat surface 76 which abuts motor housing 42. These shapes permit the resiliency of the bushing to absorb vibration produced by the motor 16 during operation.

The long length of the draw bolts 44B tends to dampen vibration caused by the motor 16 and the resiliency of the bushings 30 further dampens the vibration between the motor 16 and the transmission 20.

In FIG. 3, the motor 16 is shown with the spring clip 55A securing the motor 16 to the mounting plate 26. A second mounting means 82 is also shown securing the pump 22 to the motor 16. The second mounting means 82 is similar in construction and function to the motor mounting means as described above.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An automatic washer motor mount for connecting a motor to a gear case, said motor having a housing with an end bell at one end and a plurality of pilot studs at an opposite end and a drive shaft therethrough, said motor mount comprising:

a mounting plate secured to said gear case said mounting plate having a plurality of openings therethrough, for receiving a plurality of resilient bushings and said drive shaft, said bushings being selectively connected to said motor housing by means of said pilot studs, at least two tension arms external of said motor housing, said tension arms being connected to one end to said mounting plate and at an opposite end to said motor housing end bell and having points of contact only at said ends, whereby said motor is secured against said bushings such that vibration from said motor is dampened and is only minimally transmitted to said gear case.

2. The apparatus of claim 1, wherein said tension arms are comprised of spring clips having one end anchored in said mounting plate and having an opposite end received in an indentation in said motor housing end bell whereby spring force generated by stretching said spring clip holds said motor securely in position against said resilient bushings.

3. The apparatus of claim 1, wherein said tension arms are comprised of draw bolts having one end secured to said mounting plate and having an opposite end curved to be received in an aperture in said motor housing end bell whereby tightening said draw bolts holds said motor securely in position against said resilient bushings.

4. In an automatic washing machine having a motor with a first end and a second end connected to a transmission by a drive shaft at said first end, an easy service motor mount comprising:

a mounting plate secured to a gear case of said transmission, said mounting plate having a plurality of openings therethrough for receiving a plurality of resilient bushings; and spring clip mounting means attachable between said second end of said motor and said mounting plate and having points of contact only at said mounting plate and said second motor end, whereby said motor is secured against said bushings by said mounting means such that said motor is easily removable.

5. The motor mount of claim 4, wherein the motor is provided with pilot studs to engage with said bushings to provide positive location of said motor with respect to said transmission.

6. Means for securing a first vibration producing member to a second non-vibrating member to substantially reduce the transfer of vibration therebetween comprising:

guide means on said first member being a plurality of protrusions for establishing precise alignment with said second member;

mounting means on said second member including a plurality of apertures therein to receive said guide means;

resilient means positioned to prevent direct contact between said first member and said second member, being carried on said second guide means and received snugly in said apertures to provide lateral, rotational and axial vibration absorption;

elongated restraining means secured at a first end to said mounting means and at a second end to said first member;

said restraining means having points of contact only at said ends and being of a relatively long length whereby additional vibration is absorbed by said restraining means; and said first member having a first end and a second end spaced longitudinally apart, said first end containing said guide means and said second end having means for receiving said second end of said restraining means.

7. The apparatus of claim 6, wherein said elongated restraining means are comprised of draw bolts.

8. The apparatus of claim 6, wherein said elongated restraining means are comprised of spring clips.

9. The apparatus of claim 6, wherein said guide means comprises a plurality of pilot studs projecting from said first member.

10. The apparatus of claim 9, wherein said resilient means comprises bushings having a central aperture therethrough for receiving said pilot studs, a flat face on one end for abutting against said first member, and an exterior body shaped complementary to said apertures and said mounting means.

11. Means for securing a first vibration producing member to a second non-vibrating member to substantially reduce the transfer of vibration therebetween comprising:

guide means on said first member being a plurality of protrusions for establishing precise alignment with said second member;

mounting means on said second member including a plurality of apertures therein to receive said guide means;

resilient means positioned to prevent direct contact between said first member and said second member, being carried on said second guide means and received snugly in said apertures to provide lateral, rotational and axial vibration absorption;

elongated restraining means comprising spring clips secured at a first end to said mounting means and at a second end to said first member; and said restraining means having points of contact only at said ends and being of a relatively long length whereby additional vibration is absorbed by said restraining means.

* * * * *